United States Patent [19]

Banta et al.

[11] Patent Number: 4,593,178

[45] Date of Patent: Jun. 3, 1986

[54] REMOVABLE ELECTRIC HEATING ASSEMBLY FOR FLUID HEATERS AND BOILERS

[75] Inventors: Ira C. Banta; Wayne H. Caro, both of Louisville, Ky.

[73] Assignee: Cepeda Associates, Inc., Louisville, Ky.

[21] Appl. No.: 615,269

[22] Filed: May 30, 1984

[51] Int. Cl.[4] ..... H05B 3/82; F24H 1/20; F22B 1/28

[52] U.S. Cl. ..... 219/315; 219/275; 219/316; 219/318; 219/320; 219/534; 219/541; 219/542

[58] Field of Search ..... 219/310, 312, 314–316, 219/318–321, 328, 331, 335–338, 523, 534, 539, 541, 544, 546, 275; 122/13 A

[56] References Cited

U.S. PATENT DOCUMENTS

| | | | |
|---|---|---|---|
| 1,148,808 | 8/1915 | Thomson | 219/315 |
| 1,308,836 | 7/1919 | Bernard | 219/315 |
| 1,324,002 | 12/1919 | Barnstead | 219/318 |
| 1,329,204 | 1/1920 | Patterson | 219/318 X |
| 1,451,847 | 4/1923 | Rowe | 219/315 X |
| 1,533,268 | 4/1925 | Reid | 219/534 |
| 1,661,693 | 3/1928 | Ewart | 219/315 |
| 1,670,437 | 5/1928 | Campbell | 219/320 |
| 1,927,023 | 9/1933 | Colbie | 219/523 X |
| 2,213,464 | 9/1940 | Fogwell | 219/320 |
| 3,286,079 | 11/1966 | Hynes et al. | 219/315 X |

FOREIGN PATENT DOCUMENTS

| | | | |
|---|---|---|---|
| 590131 | 12/1933 | Fed. Rep. of Germany | 219/331 |
| 92919 | 2/1922 | Switzerland | 122/13 A |

*Primary Examiner*—A. Bartis

*Attorney, Agent, or Firm*—Maurice L. Miller, Jr.

[57] ABSTRACT

A fully removable heating element assembly for use in fluid heaters and boilers, such as the boiler contained in a $CO_2$ removal air purification system employing a monoethanolamine (MEA) solution, includes a rectangularly shaped housing open on a rear end thereof. An oversize cover plate connected to and covering an open front end of the housing is connectable to an opening in a fluid boiler. A series of elongated hollow tubes, each of which tubes is closed on its forward end and open on its rear end, are connected on rear end portions thereof to the plate so as to project forwardly of the housing into the interior of the boiler. A like series of electrical heating elements are slidably and removably inserted into the tubes and have rear end portions containing pairs of electrical terminals which project rearwardly of the plate and are confined within the housing. Elongated, flat retainer bars lying between rows of the elements and removably attached to the cover plate overlie portions of collars affixed to the elements and retain the collars flush against the plate. A bus bar made of rigid material and formed into three separate rectangular loops is disposed in the hollow interior of the housing and is removably connected to the heater element terminals.

9 Claims, 3 Drawing Figures

REMOVABLE ELECTRIC HEATING ASSEMBLY FOR FLUID HEATERS AND BOILERS

BACKGROUND OF THE INVENTION

This invention relates generally to heating element assemblies used in heater and boiler tanks for heating and boiling liquids such as water and other aqueous solutions. More specifically, this invention relates to fully removable heating element assemblies used in heater and boiler tanks which also permit removing selected individual heating elements for inspection, cleaning and/or repair and which permit replacing of worn, damaged or defective ones of such elements, all with reduced effort and reduced heater or boiler down-time.

One important application of such assemblies is in boilers used in carbon dioxide ($CO_2$) removal air purification systems. Such systems are employed in closed atmospheric environments to prevent the accumulation of high concentrations of $CO_2$ caused by human and animal exhalation. Excessive $CO_2$ build-up in a closed breathing environment can cause breathing difficulty, drowsiness and, in extreme cases, even death. A typical prior art $CO_2$ removal system utilizes a relatively cool solution of water and monoethanolamine (MEA) to absorb excessive amounts of $CO_2$ from a closed atmosphere. The $CO_2$ enriched MEA solution is thereafter cycled through a boiler where it is heated to drive off the absorbed $CO_2$, whereby gaseous carbon dioxide is separated from the closed atmosphere and collected for venting to external ambient atmosphere. The $CO_2$ depleted (lean) MEA solution is thereafter condensed and cooled back to approximately room temperature and recycled to an absorber tower where it contacts the closed atmosphere to absorb more $CO_2$.

One difficulty that has been encountered in the boilers of such prior art $CO_2$ removal systems resides in the fact that the individual electrical heater elements of the boiler heating element assembly are in direct contact with the MEA solution being heated. Such direct contact tends to cause breakdown of the MEA over a period of time which lessens its efficiency in absorbing $CO_2$ from the closed atmosphere. Moreover, as the MEA breaks down, it changes the aqueous solution from a clear to a black liquid which, in turn, causes increased corrosion of not only the heating elements but other fixtures within the system. Indeed, over a period of time solids will form in the MEA solution which tend to interfere with valve operation and liquid flow, cause corrosion in pipe fittings, plug strainer elements and produce gasket leaks. Another difficulty that has been noted using prior art heater element assemblies whose elements directly contact the solution being boiled is the tendency of such elements to short out. This is an especially dangerous situation where high voltages of as much as 440 volts are employed to heat the heater elements.

Another difficulty noted in the use of heater element assemblies in boilers which permit direct contact between the individual heater elements and the liquid being boiled is the inability to remove the same for inspection, cleaning, repair and/or replacement without first shutting down the system to allow the boiler to cool. Depending upon the size of the boiler and the mass of liquid involved, the resulting boiler down-time can be significant. In view of the possibility of dangerous arcing due to short circuits which can occur with worn, damaged or corroded heater elements, it would be highly desirable to be able to perform frequent inspections of the heater elements as part of a preventive maintenance program. However, such inspections of the prior art heater assemblies would involve excessive and often unacceptable periods of boiler down-time. Another problem resulting from the use of prior art heating element assemblies is the relevative difficulty and delay encountered when removal of the entire heating element assembly from a boiler becomes necessary.

By means of our invention these and other problems encountered in the use of prior art heating element assemblies in fluid heaters and boilers are substantially eliminated.

SUMMARY OF THE INVENTION

It is an object of the present invention to provide an improved removable heating element assembly for use in connection with fluid heaters and boilers.

It is also an object of the present invention to provide an improved removable heating element assembly for use in connection with the boiler of a carbon dioxide removal air purification system.

Briefly, in accordance with the present invention, there is provided a heating element assembly for use with a fluid heater which includes a housing being open on a rear end thereof and having a flat plate connected to and covering a forward end thereof. A plurality of spaced, elongated, hollow tubes, each of which is open on a rear end thereof and closed on a forward end thereof, are connected on rear end portions thereof to the plate so as to project forwardly of the housing. The plate defines a like plurality of spaced openings therethrough which register with the open ends of the tubes. A plurality of elongated electrical heating elements is removably inserted in the tubes, each of the elements containing a pair of electrical terminals projecting from a rear end thereof and having a collar fixedly attached to a rear end portion thereof which is adapted to lie flush against the plate when the corresponding element is fully inserted in one of the tubes such that an end portion of the element and a corresponding pair of terminals project rearwardly into the hollow interior of the housing. A retainer means is disposed in the hollow interior of the housing and is removably connected to the plate for securing the collars against the plate. Lastly, an electrical bus bar means is disposed in the housing and is removably connected to each of the pairs of terminals of the heating elements for providing electrical power thereto, the bus bar means being accessible to a remote electric power source through a surface of the housing.

These and other objects, features and advantages of the present invention will become apparent to those skilled in the art to which this invention pertains from the following detailed description and attached drawings, on which, by way of specific example, only a preferred embodiment of the invention is explained and illustrated.

DESCRIPTION OF THE PREFERRED EMBODIMENT

Figure 1:
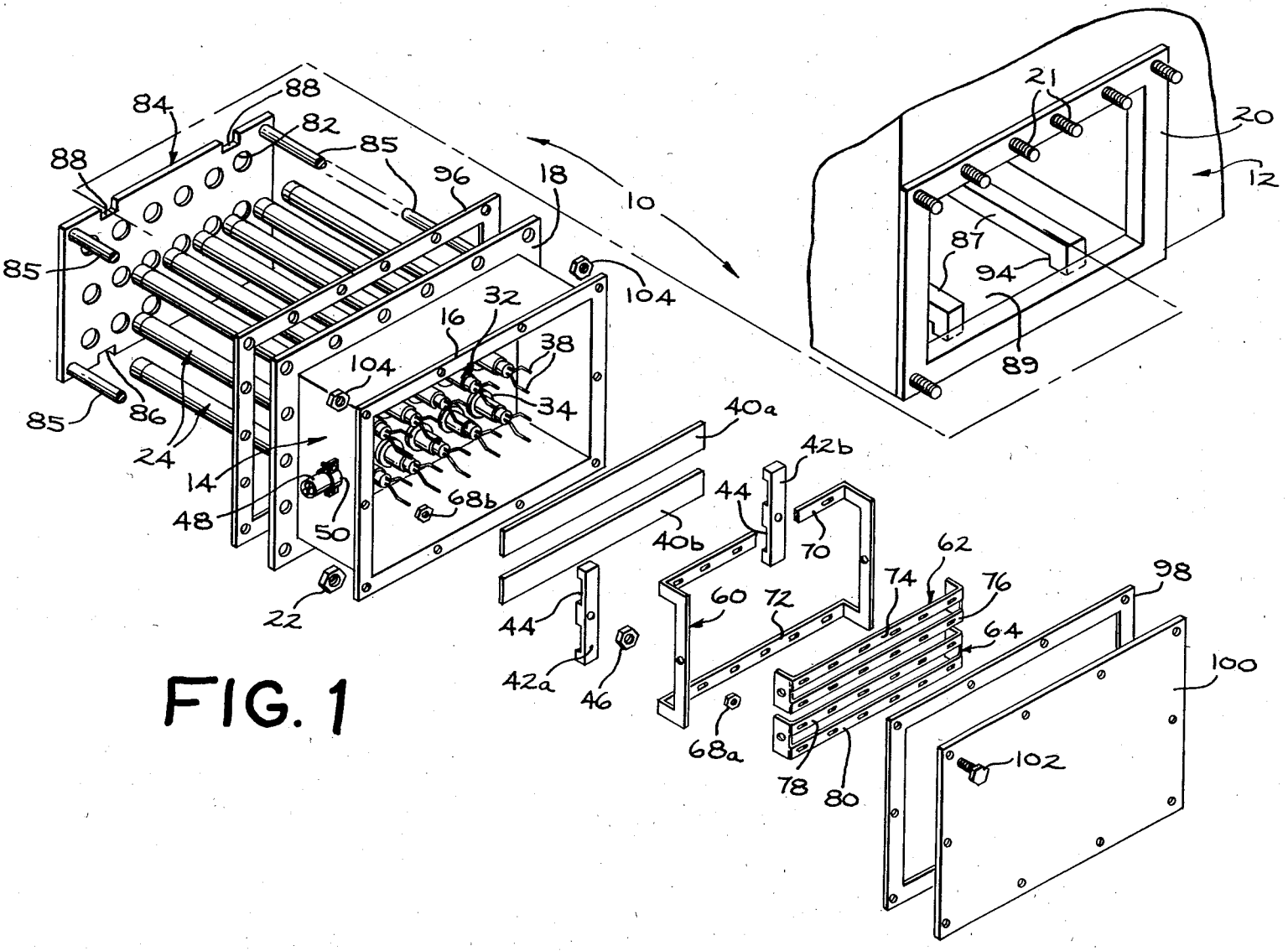
FIG. 1 shows an exploded oblique projection of a heating element assembly for use in a boiler as part of a carbon dioxide removal air purification system, thus illustrating one preferred embodiment of our invention.

Referring now to the drawing figures, there is shown, in one preferred embodiment of our invention, a heating element assembly 10 for use in a conventional fluid heater or boiler such as, for example, a boiler 12 of a $CO_2$ removal air purification system. The assembly 10 includes a generally rectangularly shaped housing 14 having upper, lower and side surfaces, and a rectangularly shaped rear opening defined by a flange 16 which extends outwardly beyond the housing surfaces. A rectangularly shaped flat plate 18 is connected to the forward edges of the housing surfaces to form a cover over the forward end of the housing 14. Edge portions of the plate 18 extend outwardly beyond the upper, lower and side surfaces of the housing 14 to form a connecting flange for connecting the plate 18 to and around an opening defining surface portion 20 of the boiler 12 by means of projecting threaded studs 21 and threaded fasteners 22.

Figure 3:
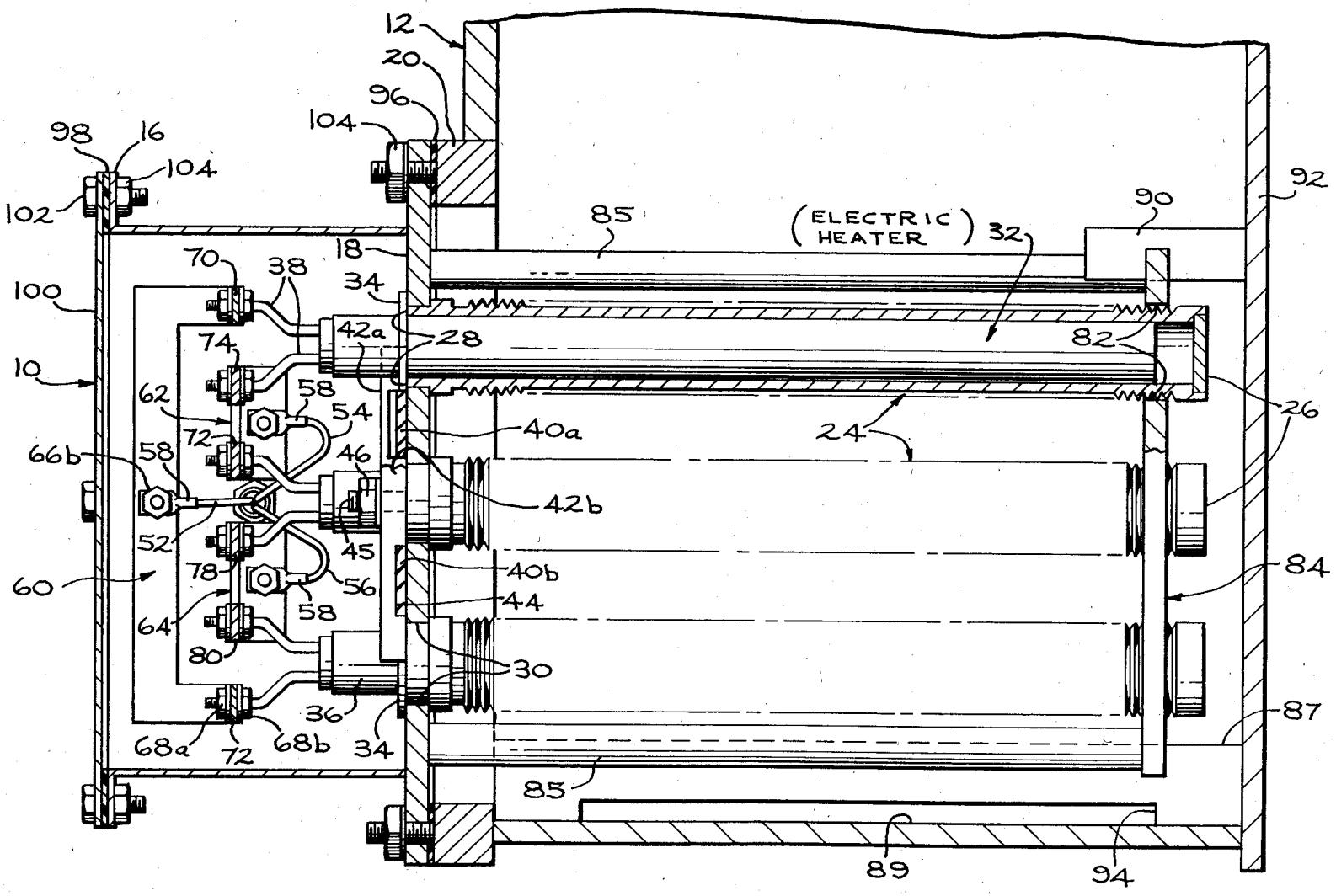
FIG. 3 shows a cross-sectional side elevation view of the assembly of FIGS. 1–2 with certain parts torn away for viewing clarity as viewed generally along cross-section lines 3—3 of FIG. 2.

A plurality of spaced, elongated, cylindrically shaped hollow tubes 24 having closed forward ends 26 (FIGS. 1 and 3 only) and open rear ends 28 (FIG. 3 only) are connected on rear end portions thereof in openings in the plate 18 so as to project forwardly of the housing 14 and plate 18. As seen most clearly in FIG. 3, the plate 18 contains a plurality of circular openings 30 therethrough into which rear end portions 28 of the tubes 24 extend so that the latter may be welded or otherwise fixedly connected to the plate 18. In this manner, the openings 30 register with the concentrically aligned smaller openings in the ends of the tubes 24.

A plurality of elongated, cylindrically shaped electrical heating elements 32 are slidably inserted in the tubes 24. Each of the elements 24 contain a circular disc shaped collar 34 fixedly connected around a rear end portion thereof which is adapted to lie flush against the rear surface of the plate 18 when each of the elements 32 is fully inserted into the tubes 24 as shown. Thus, as shown most clearly in FIG. 3, rear end portions 36 of the elements 32, each of which contains a pair of electrical terminals 38, project rearwardly out of the plate openings 30 so that both the rear end portions 36 and terminals 38 are confined within the housing 14 when the elements 32 are fully inserted in the tubes 24.

The elements 32 are retained securely in their fully inserted positions in the tubes 24 by a retainer means which includes a pair of elongated, flat bars **40*a* and 40*b* and a pair of retainer bar clamps 42*a* and 42*b*. The bar 40*a* is disposed in the hollow interior of the housing 14 between upper and middle rows of the elements 32 and the bar 40*b* is likewise disposed in the housing 14 between the middle and lower rows of the elements 32. Each of the bars 40*a*, 40*b* extend along the lengths of the rows of the elements 32 and have widths sufficient to overlap and bear against portions of the collars 34 of the rows on either side thereof. The retainer clamps 42*a*, 40*b* contain notches 44 which confine end portions of the bars 40*a*, 42*b* therein against the plate 18 and are, in turn, removably secured to a rear surface of the plate 18 by projecting threaded studs 45 and threaded fasteners 46**.

Figure 2:
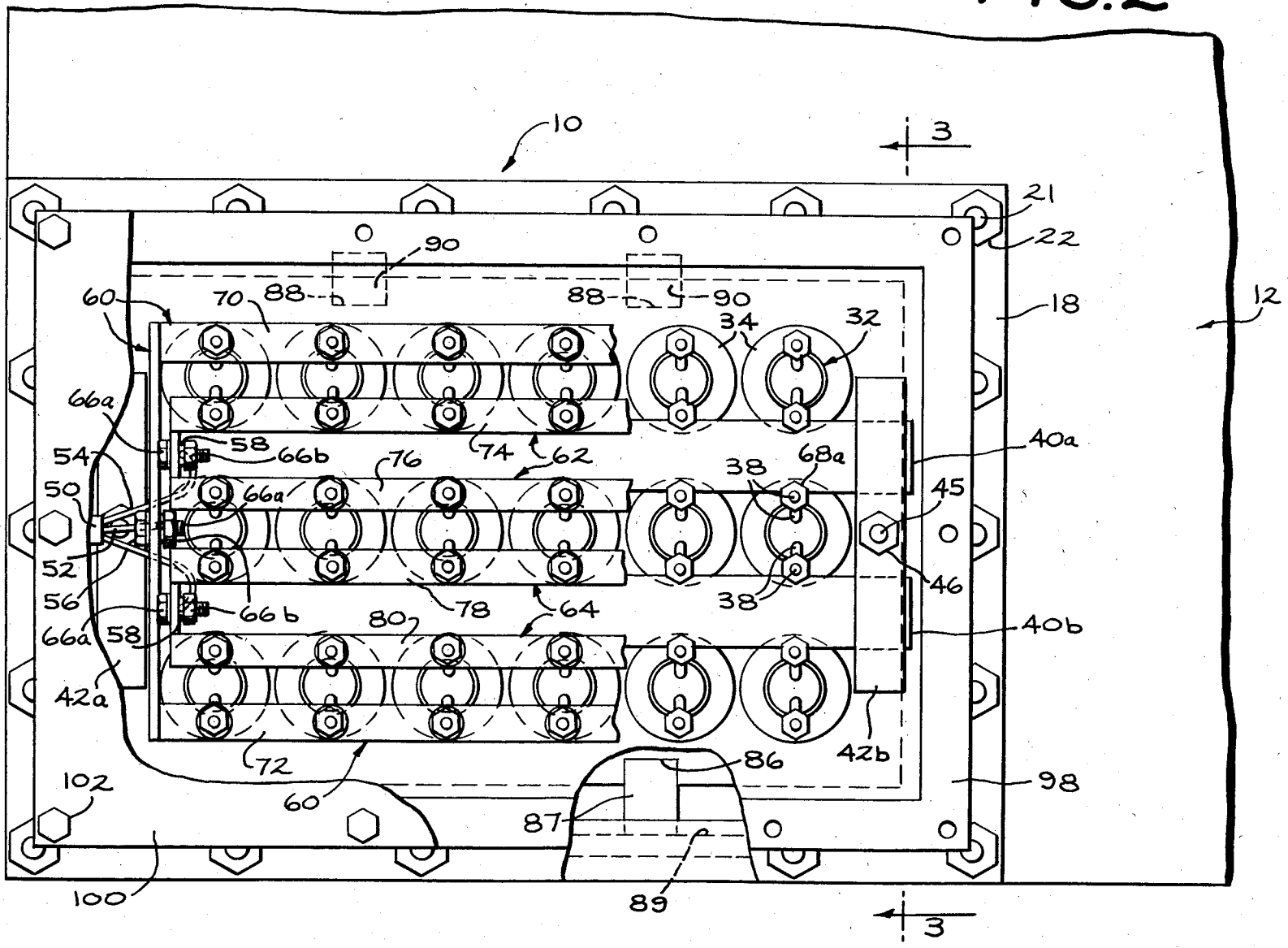
FIG. 2 shows an end elevation view of the assembly of FIG. 1 with portions of certain parts torn away for viewing clarity.

In the present example of our invention, we provide a total of eighteen separate tubes 24 and heating elements 32 arranged in three rows containing six tubes and elements each, although the number of such tubes, elements and rows employed may vary and is largely a matter of choice depending upon the particular application in which the heater assembly is to be employed. Electric power to heat the elements 32 is obtained from a suitable remote power source such as, for example, a 3-phase, 440 volt source, not shown. Such a source is connected by means of an insulated cable 48 (FIG. 1 only) to a connector 50 mounted in a side surface of the housing 14. The three phases of the power source are thus fed by means of a set of three wires 52, 54 and 56 (FIGS. 2–3 only) to suitable terminal pins 58 which are removably fastened to three electrically separated bus bars 60, 62 and 64, respectively, by means of nuts and bolts **66*a*, 66*b*. The bus bars 60, 62 and 64, which may be made of copper or other suitably rigid, electrically conductive material, are disposed within the hollow interior of the housing 14 and are also removably connected to the various terminals 38 of the elements 32 by means of pairs of nuts 68*a*, 68*b***.

Each of the bus bars 60, 62 and 64 are formed in a generally rectangularly shaped closed loop. An upper portion 70 of the bus bar 60 is connected to all of the uppermost terminals 38 in the uppermost row of the elements 32 while a lower portion 72 of the same bar is connected to all of the lowermost terminals 38 in the lowermost row of the elements 32. The remaining bus bars 62 and 64 are of identical size and shape relative to each other but are of considerably less height and somewhat lesser width than the bar 60 so as to fit within the loop of the larger bar 60 when connected to the remaining heater terminals 38. The bar 62 includes an upper portion 74 which is connected to all of the lowermost terminals 38 in the uppermost row of the elements 32 and a lower portion 76 which is connected to all of the uppermost terminals 38 located in the middle row of elements 32. Similarly, the bar 64 contains an upper portion 78 which is connected to all of the lowermost terminals in the middle row of elements 32 and a lower portion 80 which is connected to all of the uppermost terminals 38 of the lower row of elements 32. Since, in the present example, the bus bars 60, 62 and 64 are each connected to a different phase of a three phase power source, it is important that they be suitably spaced from one another around their respective loops so that electric arcing does not occur between them or any two of them.

Forward end portions of the tubes 24 are inserted through close conforming circular openings 82 contained in a second flat plate 84. The openings 82 are numbered, spaced and arranged in conformity with the numbers, spacings and arrangement of the tubes 24 as connected to the cover plate 18 so as to maintain a constant tube spacing and parallelism throughout their lengths and so as to enhance the ability of the tubes 24 to absorb vibration and shock without damage to themselves and to the elements 32. Rigid connecting rods 85 connected between the four corner portions of each of the plates 18 and 84 prohibit the forward end portions of the tubes 24 from slipping out of the openings 82 after initial installation. To aid in aligning the tubes 24 and plate 84 for insertion into the opening of the boiler tank 12, a pair of spaced, rectangularly shaped, downwardly opening notches 86 are formed in lower edge portions of the plate 84 which conform in close fitting, sliding relation to a pair of elongated rails 87 of rectangular cross-section which extend across a floor 89 of the interior of the tank 12 in endwise alignment with said opening (See FIG. 1). Similarly, a pair of spaced rectangularly shaped, upwardly opening notches 88 may be formed in an upper edge portion of the plate 84 which engage close conforming slide bars 90 which are connected to and project forwardly from a rear wall 92 of the boiler 12 a short distance across the latter as the plate 84 slides rearwardly along the lower rails 87. The bars 87 and 90 thus further enhance the ability of the tubes 24 and elements 32 to absorb mechanical vibration and shock when the assembly 10 is in a fully inserted position in the boiler 12 in addition to providing alignment and guide means for ease of insertion and removal of the assembly 10 into and out of the boiler 12. Slots 94 are provided in the lower rails 87 to allow liquid to be fully drained from the floor of the boiler 12 which might otherwise be trapped on one side or the other of such rails.

Vapor impervious rectangularly shaped gaskets 96 and 98 are provided, the first being disposed between the cover plate 18 and the flange 20 and the second being disposed between a back cover plate 100 and the flange 16 of the housing 14. The back cover plate 100 is removably secured to the flange 16 by means of suitable nuts and bolts 102 and 104.

Although the subject invention has now been described with respect to specific details of a certain preferred embodiment thereof, it is not intended that such details limit the scope of our invention otherwise than as is specifically set forth in the following claims.

We claim:

1. A heating element assembly for use with a fluid heater comprising a housing being open on a rear end thereof and having a flat cover plate connected to and covering a forward end thereof;

a plurality of spaced, elongated, hollow tubes, each of said tubes being open on a rear end thereof and closed on a forward end thereof and being connected on a rear end portion thereof to said cover plate so as to project forwardly of said housing, said cover plate defining a like plurality of spaced openings therethrough which register with the open end of said tubes;

a plurality of elongated electrical heater elements removably inserted in said tubes, each of said elements containing a pair of electrical terminals on a rear end thereof and having a collar fixedly attached to a rear end portion thereof which is adapted to lie flush against said plate when said element is fully inserted in one of said tubes such that an end portion of said element and said pair of terminals project rearwardly into the hollow interior of said housing;

retainer means disposed in the hollow interior of said housing and removably connected to said cover plate for securing said collars against said cover plate; and electrical bus bar means disposed in said housing and removably connected to each of said pairs of terminals for providing electrical power to said elements, said bus bar means being electrically accessible to a remote source of electric power through a surface of said housing, said tubes and heating elements being arranged in at least two rows, said retainer means comprising at least one elongated, flat bar of width sufficient to overlie portions of the collars of said elements contained in adjacent rows located on opposite sides of said bar.

2. The assembly of claim 1 wherein said flat cover plate contains edge portions which extend outwardly beyond and around the surface of said housing to form a connecting flange for connecting said cover plate to and around an opening defining surface portion of a fluid heater such that said tubes project into the interior of the heater for heating a fluid contained therein.

3. The assembly of claim 1 further comprising a second flat plate containing a plurality of spaced openings therethrough through which forward end portions of said tubes extend, said second plate being spaced from and connected to said flat cover plate by a plurality of rigid rods such that the forwardly projecting end portions of said tubes are secured in their spaced relations to one another.

4. The assembly of claim 3 wherein said second flat plate defines a pair of rectangularly shaped, spaced, upwardly opening notches in an upper edge portion thereof and a pair of rectangularly shaped, downwardly opening, spaced notches in a lower edge portion thereof for sliding along conformingly spaced and shaped rails located above and below opening defining surface portions in the interior of a fluid heater, thereby to align said tubes and second plate in inserting and removing the same into and from the heater.

5. The assembly of claim 1 wherein said tubes and heating elements are arranged in three rows, said retainer means comprising a pair of elongated, flat bars, a first one of said bars being disposed between and along a first and second row of said elements, a second one of said bars being disposed between a second and third row of said elements, each said bar being of a width sufficient to overlie a portion of the collars of all of the elements contained in the two rows located on either side of said bar, and a pair of retainer bar clamps extending across opposite end portions of said bars and removably secured to said flat cover plate to secure said bars against said collars and to secure said collars against said flat cover plate.

6. The assembly of claim 1 wherein said tubes and heating elements are arranged in three rows, said bus bar means comprising a first rectangularly shaped loop of rigid electrically conductive material removably connected along an upper portion of said first loop to upper ones of the pairs of terminals connected to the elements which form an upper row thereof and removably connected along a lower portion of said first loop to lower ones of the pairs of terminals connected to the elements which form a lower row thereof;

a second rectangularly shaped loop of rigid electrically conductive material of substantially lesser height than said first loop disposed within said first loop and removably connected along an upper portion of said second loop to lower ones of the pairs of terminals connected to the elements which form said upper row and removably connected along a lower portion of said second loop to upper ones of the pairs of terminals connected to the elements which form a middle row thereof; and a third rectangularly shaped loop of rigid electrically conductive material of a height substantially equal to the height of said second loop disposed in said first loop below said second loop and being removably connected along an upper portion of said third loop to lower ones of the pairs of terminals connected to the elements which form said middle row and being removably connected along a lower portion of said third loop to upper ones of the pairs of terminals connected to the elements which form said lower row, each of said loops being electrically separate from one another so as to provide a bus bar for connection to a different phase of a threephase power source.

7. The assembly of claim 1 further comprising a back cover plate, said housing containing an outwardly extending flanged rear opening for removable connection to edge portions of said back cover plate.

8. The assembly of claim 1 wherein said pluralities of tubes and heating elements is eighteen, said tubes and elements being arranged in three rows of six tubes and elements each to form a square matrix of said tubes and elements.

9. In combination with a boiler contained in a $CO_2$ removal air purification system, a heating element assembly comprising:

a housing being open on a rear end thereof and having a flat back plate connected to and covering a forward end thereof;

a plurality of spaced, elongated, hollow tubes, each of said tubes being open on a rear end thereof and closed on a forward end thereof and being connected on a rear end portion thereof to said cover plate so as to project forwardly of said housing, said cover plate defining a like plurality of spaced openings therethrough which register with the open ends of said tubes;

a plurality of elongated electrical heating elements removably inserted in said tubes, each of said elements containing a pair of electrical terminals on a rear end thereof and having a collar fixedly attached to a rear end portion thereof which is adapted to lie flush against said plate when said element is fully inserted in one of said tubes such that an end portion of said element and said pair of terminals project rearwardly into the hollow interior of said housing;

retainer means disposed in the hollow interior of said housing and removably connected to said flat plate for securing said collars against said cover plate;

electrical bus bar means disposed in said housing and removably connected to each of said pairs of terminals for providing electrical power to said elements, said bus bar means being electrically accessible to a remote source of electric power through a surface of said housing; and a second flat plate containing a plurality of spaced openings therethrough through which end portions of said tubes extend, said second plate being spaced from and connected to said flat cover plate by a plurality of rigid rods such that the forwardly projecting end portions of said tubes are secured in their spaced relations to one another;

said boiler including a boiler tank defining an opening in a surface thereof into which said second plate and tubes are removably disposed; and a pair of spaced, elongated guide rails disposed on a floor of said tank and extending across said tank in endwise alignment with said tank opening, said second plate containing a pair of downwardly opening notches formed in a lower edge portion thereof for conforming in close fitting, sliding relation to said guide rails, said flat cover plate being removably connectable to the opening defining edge portion of an exterior surface of said tank.

* * * * *